US005094670A

United States Patent [19]

Imada

[11] Patent Number: 5,094,670

[45] Date of Patent: Mar. 10, 1992

[54] METHOD OF PRODUCING POLISHING SHEET MATERIAL

[75] Inventor: Katsuhiko Imada, Ehime, Japan

[73] Assignee: Fuji Spinning Co., Ltd., Tokyo, Japan

[21] Appl. No.: 660,750

[22] Filed: Feb. 26, 1991

[30] Foreign Application Priority Data

Nov. 15, 1990 [JP] Japan ..... 2-309947

[51] Int. Cl.[5] ..... B24D 3/34

[52] U.S. Cl. ..... 51/293; 51/294; 51/295; 51/298

[58] Field of Search ..... 51/293, 294, 295, 298

[56] References Cited

U.S. PATENT DOCUMENTS

| | | | |
|---|---|---|---|
| 4,282,011 | 9/1981 | Terpty | 51/298 |
| 4,543,106 | 9/1985 | Parekh | 51/295 |
| 4,751,797 | 6/1988 | Fujimori | 51/293 |
| 4,842,619 | 6/1989 | Fritz et al. | 51/293 |
| 4,929,432 | 4/1990 | Budinger et al. | 51/298 |
| 5,015,266 | 5/1991 | Yamamoto | 51/293 |

*Primary Examiner*—Mark L. Bell
*Assistant Examiner*—Deborah Jones
*Attorney, Agent, or Firm*—Fleit, Jacobson, Cohn, Price, Holman & Stern

[57] ABSTRACT

A method of producing an abrasive backing or a polishing sheet material which has a nonwoven fabric of a synthetic fiber having a network structure and impregnated with a polyurethane solution. The method has the steps of completely coagulating and drying the polyurethane solution to prepare a base material, removing a skin layer from each surface thereof, dipping the resultant base material in an aqueous solution of a solvent for a short period of time, and treating it in a high-temperature atmosphere for a short period of time.

3 Claims, 1 Drawing Sheet

METHOD OF PRODUCING POLISHING SHEET MATERIAL

BACKGROUND OF THE INVENTION

The present invention relates to a method of producing a polishing sheet material suitable for use in polishing and finishing the surface of a semiconductor IC wafer, glass, metal and the like.

A conventional method of producing the polishing sheet material or cloth comprises impregnating a nonwoven fabric with a polyurethane resin solution, dipping the impregnated fabric in a water bath or an aqueous solution of dimethylformamide so as to effect complete coagulation, washing the product with water, and drying the washed product. In the sheet material produced by the conventional method, the polyurethane resin has a porous structure, so that it is too soft, thereby causing the edges thereof to be "sagged" and suffer from flagging or sugging at the time of use, and so it has been impossible to obtain a wafer having sharp edges. Accordingly, an attempt has been made in order to strengthen the fiber network structure, which includes the steps of slicing the sheet material obtained by the above-described conventional method, removing the skin layer from each surface thereof, and performing high-temperature heat treatment so as to melt the polyurethane resin and to effect fusion around the fibers. Another attempt was made to use polyurethane resins having different melting temperatures to facilitate the above-described melting and fusion (see Japanese Patent Laid-Open No. 62-297061/1987).

The present inventor conducted a study to obtain an improved polishing sheet material, and proposed a method of obtaining the polishing sheet material which comprises impregnating a nonwoven fabric of a synthetic fiber having a network structure with a polyurethane solution, performing incomplete coagulation of the same, removing any remaining solvent in an atmosphere heated at 75°±5° C., and performing complete coagulation, as disclosed in Japanese Patent Application No. 2-7921, filed Jan. 17, 1990.

Experiments have been repeated in accordance with the method described in the above-described Japanese Patent Laid-Open No. 62-297061/1987, and observations have been made by means of scanning electron photo-micrographs. As a result, it has been found that there are a large number of residual microvoid structures in the resin portion present between fibers forming the skin layer portion of the material. Regarding the attempt to eliminate the microvoids by subjecting the same to high-temperature heat treatment so as to effect the melting and fusion of the resin, it had a limitation of its own attributed to the narrowness of the temperature control range for the high-temperature heat treatment. On the other hand, a considerable improvement has been achieved by the invention disclosed in the above-described Japanese Application No. 2-7921. However, in respect of the prolongation of the life of the polishing sheet material which is an especially strong desire at present, it is unsatisfactory as yet.

SUMMARY OF THE INVENTION

An object of the present invention is to provide an improvement in prolongation of the life of the polishing sheet material.

Another object of the present invention is to provide an improved polishing sheet material structure wherein the entire layers are free of microvoid structures as completely as possible and the polyurethane resin fixes together the synthetic fibers forming a network structure, with a resin film formed only around the synthetic fibers, to thereby readily obtain the sheet material exhibiting low Taber abrasion values and being suitable for polishing.

A further object of the present invention is to provide a new method of producing the polishing sheet material, which can remove the drawbacks inherent to the conventional methods.

Another object of the present invention is to provide an improved method of producing the polishing sheet material, which can eliminate completely the microvoids.

According to the present invention, there is provided a method of producing the polishing sheet material which has a nonwoven fabric of a synthetic fiber having a network structure and impregnated with a polyurethane solution, comprising the steps of completely coagulating and drying the polyurethane solution to prepare a base material, removing a skin layer from each surface thereof, dipping the resultant base material in an aqueous solution of a solvent for a short period of time, and treating it in a high-temperature atmosphere for a short period of time.

In another aspect of the present invention, after removal of the skin layer from each surface of the base material, there are provided steps of slicing the resultant base material into a plurality of sheets, dipping the sheets in an aqueous solution of a solvent for a short period of time, and treating the sheets in a high-temperature atmosphere for a short period of time.

A preferable nonwoven fabric of a synthetic fiber having a network structure to be used in the present invention is one which is obtained by forming staple fibers of a synthetic fiber, such as those of polyamide, polyester, polyacrylonitrile or polypropylene, into a nonwoven fabric by means of the conventional dry nonwoven fabric manufacturing method and performing needle punching to maintain the shape of the nonwoven fabric. Of the fibers, polyester fibers which are insoluble in solvents and have excellent physical properties are most desirable.

The nonwoven fabric is impregnated with a polyurethane solution. Examples of the polyurethane resin to be used for this purpose include polyester and polyether polyurethane resins which may be used individually or in combination. From the viewpoint of physical properties, a preferred polyurethane solution is one which is obtaied by dissolving a polyether polyurethane resin in a solvent, such as N,N-dimethylformamide, N,N-dimethylacetamide or methyl ethyl ketone. Although the resin concentration is arbitrary, it is desirably about 20% for the convenience of handling.

The nonwoven fabric is completely impregnated with the above-described polyurethane solution until the polyurethane resin uniformly penetrates into the interior of the nonwoven fabric layer, and wrung by means of a wringer so as to attain a predetermined resin pickup. Subsequently, the nonwoven fabric impregnated with the polyurethane resin is dipped in hot water or water so as to effect complete solvent removal and complete coagulation. Thereafter, water is completely removed from the treated nonwoven fabric by using a conventional dryer, thereby preparing a base material.

The skin layers are sliced off from both of the surfaces of the base material thus obtained in order to remove the nonuniform resin-adherent portion which is attributed to the transfer of the resin by the treatments, such as drying, to the skin layers of both surfaces of the base material.

The base material having the skin layers of both of the surfaces thereof sliced off may optionally be sliced into a plurality of sheets having a thickness suitable for the intended specific application to obtain another form of the base material. The base material having the skin layers of both surfaces thereof removed or the base material split by slicing is then dipped in an aqueous solution of a solvent obtained by adding water to a solvent capable of dissolving the polyurethane resin, for example, one used in the above-described polyurethane solution. The solvent concentration of the aqueous solution is freely selected in accordance with the amount of the adherent polyurethane resin and the excellent properties to be realized for the polishing sheet material. The dipping time may also be freely selected. However, a long dipping time possibly causes the resin which is penetrated into the nonwoven fabric to be entirely dissolved out. Hence, too long dipping time is unfavorable. In the present invention, it is generally preferred that the dipping time be not greater than 10 seconds. After the dipping in the aqueous solution, the sheet material is promptly wrung by means of a wringer and then dried in a high-temperature atmosphere for a short period of time, thereby obtaining the polishing sheet material. It is not favorable that the temperature of the high-temperature atmosphere is elevated to such an extent that the resin is melted or the synthetic fiber forming the nonwoven fabric is melted. In the present invention, it is preferred that the temperature be about 150° C., and that the time be about 30 minutes. The above-described method provides an excellent polishing sheet material wherein the polyurethane resin firmly bonds the synthetic fibers together throughout the whole layer portions of the polishing sheet material and coats the surface of the synthetic fibers to thereby avoid the presence of residual microvoids or the like.

PREFERRED EMBODIMENTS OF THE INVENTION

Figure 1:
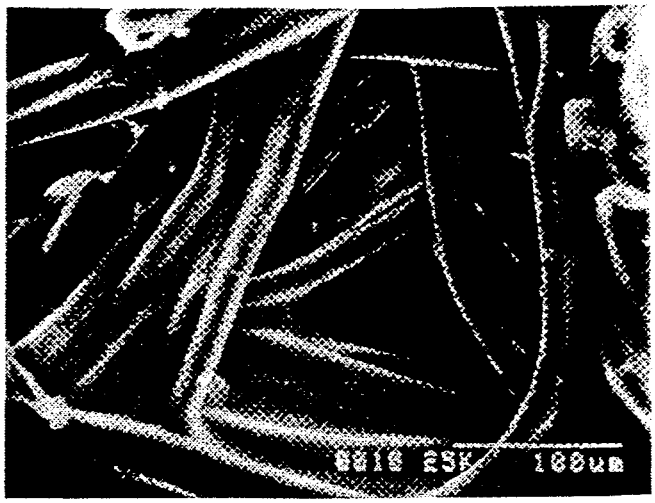
FIG. 1 is a scanning electron photograph (400 magnifications) of the surface fiber conditions of the polishing sheet material of sample No. 5 obtained in Example 1 according to the present invention, FIG. 2, similar to FIG. 1, shows the surface fiber conditions of the polishing sheet material abrasive backing of sample No. 8 described as a comparison in Example 1, and FIG. 3, similar to FIG. 1, shows the surface fiber conditions of the polishing sheet material of Comparative Example 1.

The present invention will now be described in more detail with reference to the following Examples, which however should not be construed to be limiting the present invention.

The measurements of physical properties mentioned in the Examples were carried out by the following methods.

(1) Density (g/cm$^3$)

From a sample, 50 mm wide edges were cut off to prepare three test pieces of 100×100 mm in size. The weight of each of the pieces was measured to calculate an average g/cm$^3$ value from the measured weights.

(2) Compressibility, elastic modulus in compression (%)

Three test pieces each having a size of 2×2 cm were cut off. Using a YSS-system, Schopper-type of thickness meter manufactured by Yasuda Seiki Co., Ltd., Japan, the thickness $t_0$ was measured after compression under a load of 100 g for 30 seconds. Subsequently, the thickness $t_1$ was measured after compression under a load of 100 g for 30 seconds. Subsequently, the thickness $t_1$ was measured after continued compression under a load of 900 g for 5 minutes.

Thereafter, the load of 900 g was removed, and each of the test pieces was allowed to stand still for 5 minutes without any load application. Again, 100 g compression was applied for 30 seconds, and then the thickness $t_2$ was measured. Calculation was performed by the following formulae.

$$\text{compressibility} = (t_0 - t_1/t_0) \times 100$$

$$\text{elastic modulus in compression} = (t_2 - t_1/t_0 - t_1) \times 100$$

(3) Hardness

A durometer of Type A (manufactured by The shore Instrument & Mfg. Co.) was used, and four test pieces of 2×2 cm in size which were piled one upon another so as to have a thickness of 4.5 mm or more were disposed on a test mount, and a pressurized needle was caused to fall thereon from a 25 mm height. Measurement was made at three points of the test pieces piled to calculate an average value.

(4) Water vapor permeability (mg/cm$^2$/hr)

Measured according to the Japanese Industrial JIS K-6549. The exployed sealing wax was composed of beeswax and paraffin in proportions of 60:40.

(5) Taber abrasion (mg/1000 cycles)

Tests were made by using a Taber abrasion tester munufactured by Toyo Measuring Instument Co., Ltd., Japan. The test piece was allowed to stand still until it assumed normal condition (room temperature: 20°±2° C., humidity: 65±2%). Prior to measurement, adherent fibers or the like were completely brushed off. The weight of the test piece A (A mg) was then measured by a chemical balance, and the test piece was mounted on the tester wherein the load was set at 500 g, abrasion wheel H-22 was applied and the revolution was set at 1000 cycles to conduct abrasion test. After the completion of the operation, the weight of the resultant test piece B (B mg) freed of the abrasion layer was measured. The testing was repeated twice and the results were calculated by the following formula to obtain an average value:

$$\text{Taber abrasion} = A - B$$

EXAMPLE 1

Use was made of nonwoven fabric having a thickness of 4.2 mm and an areal density of 880 g/m$^2$ as prepared by laminating webs of 3-denier polyester fibers having a fiber length of 51 mm and performing needle punching at a rate of 700 needles per $cm^2$. The nonwoven fabric was impregnated with a solution of an ether polyurethane resin (trade name: Sanprene, a product of Sanyo Chemical Industry Co., Ltd., Japan, average molecular weight: 2000, a dimethylformamide solution having a resin concentration of 20%), and wrung by means of a roll press at a clearance of 3.5 mm under a pressure of 3 $Kg/cm^2$ so as to effect uniform impregnation.

The resultant resin-impregnated nonwoven fabric was dipped in a water stream at ordinary temperature for 10 hours to effect complete solvent removal and complete coagulation. Subsequently, the resultant nonwoven fabric was taken out of the water, subjected to water washing and pressing three times, and dried in a dryer kept at 100° C. for 2 hours.

Figure 2:
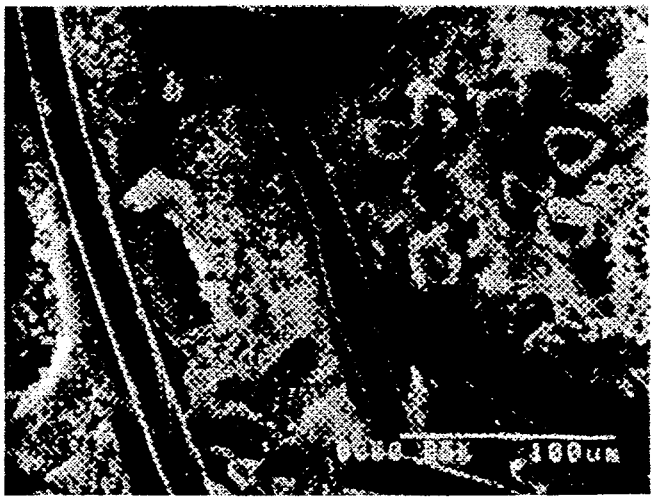

The skin layer of each of the two surfaces of the obtained resin-impregnated nonwoven fabric was removed in a thickness of 0.8 mm, totally 1.6 mm, and the resultant nonwoven fabric was sliced at the center thereof into two split resin-impregnated nonwoven fabrics having one half of the original thickness. From the resultant nonwoven fabrics, seven samples were taken, respectively dipped for 5 seconds in aqueous dimethylformamide solutions having dimethylformamide to water weight ratios of 1:1, 2:1, 3: 1, 4: 1, 5:1, 6:1 and 7 : 1. After the completion of the 5-second dipping, the samples were taken out, wrung by a roll press at a clearance of 3.5 mm under a pressure of 3 $Kg/cm^2$, and treated in a dryer wherein a temperature atmosphere of 140° C. was formed for 20 minutes. Thus, the polishing sheet material sample Nos. 1 to 7 were obtained. The amount of an adherent resin was 35%. With respect to the sample Nos. 1 to 7 and sample No. 8 which was obtained by the above-described splitting and not subjected to the dipping treatment in the aqueous dimethylformamide solutions, the physical properties were measured. The results are given in Table 1. The scanning electron photomicrographs depicting the surface conditions of sample Nos. 5 and 8 are respectively shown in FIGS. 1 and 2. No microvoid is observed in the polishing sheet material produced by the method of the present invention.

TABLE 1

| | Sample No. | | | | | | | |
|---|---|---|---|---|---|---|---|---|
| | 1 | 2 | 3 | 4 | 5 | 6 | 7 | 8 |
| Thickness | 1.38 | 1.33 | 1.37 | 1.40 | 1.38 | 1.35 | 1.33 | 1.40 |
| Density | 0.38 | 0.39 | 0.38 | 0.38 | 0.38 | 0.34 | 0.32 | 0.38 |
| Compressibility | 4.2 | 4.5 | 4.0 | 3.5 | 3.2 | 3.3 | 4.2 | 4.0 |
| Elastic modulus in compression | 76.5 | 79.6 | 80.1 | 82.0 | 84.6 | 84.4 | 80.8 | 74.6 |
| Hardness | 74.3 | 75.7 | 76.7 | 78.0 | 79.8 | 79.3 | 74.2 | 73.8 |
| Water vapor permeability | 12.4 | 12.5 | 13.3 | 13.3 | 13.4 | 13.2 | 14.2 | 9.7 |
| Taber abrasion | 94.0 | 70.1 | 67.7 | 39.5 | 28.2 | 40.1 | 69.3 | 103.0 |

EXAMPLE 2

The polishing sheet material sample Nos. 9 to 15 were prepared in substantially the same manner as that of Example 1, except that the resin-impregnated nonwoven fabric was wrung by a roll press at a clearance of 2.7 mm under a pressure of 3 $kg/cm^2$ while it was performed at a clearance of 3.5 mm under a pressure of 3 $Kg/cm^2$ in Example 1. Regarding these polishing sheet materials, the amount of an adherent resin was 25%. The physical property measurement results of sample Nos. 9 to 15 are as shown in Table 2.

TABLE 2

| | Sample No. | | | | | | |
|---|---|---|---|---|---|---|---|
| | 9 | 10 | 11 | 12 | 13 | 14 | 15 |
| Thickness | 1.36 | 1.34 | 1.33 | 1.33 | 1.36 | 1.33 | 1.39 |
| Density | 0.31 | 0.30 | 0.33 | 0.30 | 0.32 | 0.31 | 0.32 |
| Compressiblity | 6.0 | 6.5 | 6.1 | 6.3 | 6.3 | 6.2 | 6.5 |
| Elastic modulus in compression | 71.9 | 75.7 | 74.4 | 76.1 | 78.9 | 73.9 | 72.4 |
| Hardness | 74.5 | 75.0 | 73.2 | 75.7 | 74.3 | 73.3 | 71.7 |
| Water vapor permeability | 13.9 | 14.1 | 14.4 | 14.5 | 14.9 | 15.0 | 15.5 |
| Taber abrasion | 102.6 | 94.6 | 87.8 | 73.8 | 71.6 | 85.4 | 96.0 |

EXAMPLE 3

The polishing sheet material sample Nos. 16 to 22 were prepared in substantially the same manner as that of Example 1, except that the resin-impregnated nonwoven fabric was wrung by a roll press at a clearance of 4.1 mm under a pressure of 3 $Kg/cm^2$. Regarding these poliching sheet materials, the amount of an adherent resin was 45%. The physical property measurement results of sample Nos. 16 to 22 are as shown in Table 3.

TABLE 3

| | Sample No. | | | | | | |
|---|---|---|---|---|---|---|---|
| | 16 | 17 | 18 | 19 | 20 | 21 | 22 |
| Thickness | 1.37 | 1.32 | 1.32 | 1.31 | 1.36 | 1.35 | 1.35 |
| Density | 0.42 | 0.43 | 0.41 | 0.41 | 0.40 | 0.41 | 0.38 |
| Compressibility | 3.9 | 3.3 | 3.2 | 3.2 | 3.2 | 3.5 | 3.3 |
| Elastic modulus in compression | 75.0 | 74.6 | 77.9 | 80.5 | 82.9 | 80.0 | 76.0 |
| Hardness | 78.3 | 77.2 | 78.0 | 80.5 | 79.8 | 79.2 | 79.0 |
| Water vapor permeability | 12.0 | 12.9 | 11.9 | 11.8 | 11.6 | 11.8 | 13.1 |
| Taber abrasion | 95.8 | 68.4 | 59.2 | 54.6 | 42.4 | 56.4 | 60.2 |

COMPARATIVE EXAMPLE 1

Use was made of a nonwoven fabric having a thickness of 4.2 mm and an areal density of 860 $g/m^2$ as produced by laminating webs of 3-denier polyester fibers having a fiber length of 51 mm and performing needle punching at a rate of 700 needles per $cm^2$. This fabric was dipped in the polyurethane solution used in Example 1, and wrung by means of a roll press at a clearance of 3.5 mm under a pressure of 3 $Kg/cm^2$ so as to effect uniform impregnation.

Figure 3:
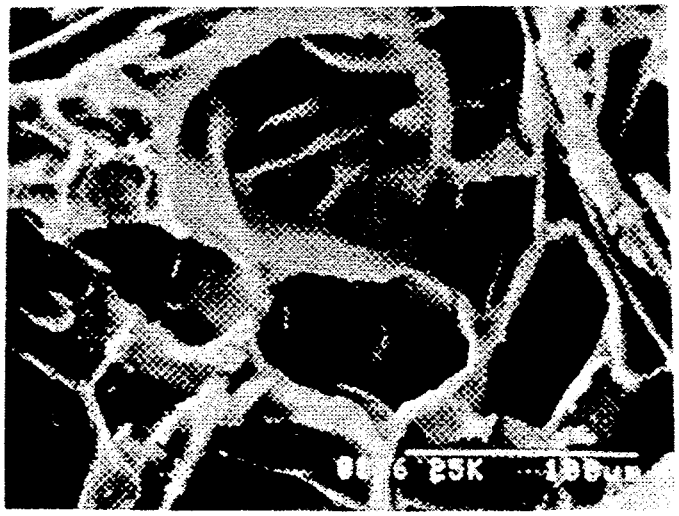

The resultant resin-impregnated nonwoven fabric was dipped in water at ordinary temperature (20° C.) for 50 minutes to effect incomplete coagulation, wrung by means of a roll press, and immediately dried in a dryer kept at 75°±5° C. for 2 hours. In the resultant nonwoven fabric, the amount of an adherent resin was 38%. The resultant nonwoven fabric was sliced into two split resin-impregnated nonwoven fabrics each having a thickness of 2.1 mm, and the skin layer of each of the resultant nonwoven fabrics was removed in a thickness of 0.8 mm. As a result, two polishing sheet materials each having a thickness of 1.3 mm wherein the amount of an adherent resin was 35%, were obtained. The physical properties of the polishing sheet materials were measured. The density was 0.41 $g/cm^3$, the compressibility 3.3%, the elastic modulus in compression 82.3%, the hardness 80.5, the water vapor permeability 13.8 mg/cm$^2$/hr, and the Taber abrasion 61.6 mg/1000 cycles. A scanning electron photomicrograph of the surface fiber condition is as shown in FIG. 3. As is apparent from FIG. 3, there is no microvoid observed, but there is a pretty large amount of residual resin films between fibers.

Application Example

Each of the polishing sheet materials of sample Nos. 5, 13 and 20 respectively obtained in Examples 1, 2 and 3 and the polishing sheet material obtained in Comparative Example 1 was bonded by a double coated adhesive tape to the whole surface of the surface plate (diameter 812 mm) of a one side polishing machine manufactured by Speedfam Co., Ltd., Japan (model 32 SPAW). By using colloidal silica particles, a silicon wafer (125 mm in diameter) was polished under such conditions that the revolution rate was 87 rpm, the applied pressure was 500 g/cm$^2$, and one cycle was 20 minutes.

As a result, sample Nos. 5, 13 and 20 respectively withstood the use for 120, 130 and 110 hours, whereas the polishing sheet material of the Comparative Example withstood the use for only 83 hours. The wafers polished by the polishing sheet materials backings of the Examples were superior in flatness and prevention of surface flagging to the wafer polished by the polishing sheet material of the Comparative Example.

As is apparent from the foregoing description, according to the method of the present invention, the polishing sheet material is obtained by subjecting a polyurethane-impregnated nonwoven fabric to comlete coagulation, drying, and removal of the skin layer from both surfaces thereof to prepare a base material, which is optionally sliced into at least two split base materials each having a thickness suitable for the intended specific application, and dipping the base material in an aqueous solution of a solvent for a short period of time, followed by treatment in a high-temperature atmosphere for a short period of time. By virtue of this method, the obtained polishing sheet material is thoroughly free of microvoids, exhibits the most desirable physical properties as the polishing sheet material having lower Taber abrasion, and ensures a prolonged service life.

What is claimed is:

1. A method of producing a polishing sheet material, said polishing sheet material having a nonwoven fabric of a synthetic fiber of a network structure and impregnated with a polyurethane solution, comprising the steps of:

completely coagulating said polyurethane solution and drying said nonwoven fabric to prepare a base material, removing a skin layer from each surface of said base material, dipping said base material in an aqueous solution of a solvent for a short period of time, and treating said base material in a high-temperature atmosphere for a short period of time.

2. A method of producing a polishing sheet material, said polishing sheet material having a nonwoven fabric of a synthetic fiber of a network structure and impregnated with a polyurethane solution, comprising the steps of:

completely coagulating polyurethane solution and drying said nonwoven fabric to prepare a base material, removing a skin layer form each surface of said base material, slicing said base material into a plurality of sheets, dipping said sheets in an aqueous solution of a solvent for a short period of time, and treating said sheets in a high-temperature atmosphere for a short period of time.

3. A method of producing a polishing sheet material, said polishing sheet material having a nonwoven fabric of a network structure and impregnated with a polyurethane solution, wherein said nonwoven fabric of a network structure being a staple fiber of a synthetic fiber of material selected from polyamid, polyester, polyacrylonitrile and polypropylene, and said polyurethane solution is selected from polyester and polyether polyurethane resins solely or in combination, comprising the steps of:

completely impregnating said nonwoven fabric of a network structure with said polyurethan solution until the polyurethan resin uniformly penetrates into an interior of said nonwoven fabric, wringing said nonwoven fabric to attain a predetermined pickup, dipping said nonwoven fabric in water to effect complete solvent removal and complete coagulation, and drying said nonwoven fabric to thereby prepare a base material, removing skin layers from surfaces of said base material, thereby removing a nonuniform resin-adherent portion due to transfer of the resin during previous treatments of drying, dipping said base material in an aqueous solution of a solvent, said solvent being obtained by adding water to a solvent capable of dissolving the polyurethan resin, drying said base material in a high-temperature atmosphere of about 150° C. for about 30 minutes.

* * * * *